US006470511B1

(12) United States Patent
Smale

(10) Patent No.: US 6,470,511 B1
(45) Date of Patent: Oct. 29, 2002

(54) SHOWER SCREENS

(76) Inventor: Gregory J. Smale, 90 Shakespeare Road, Milford, Auckland (NZ)

( * ) Notice: Subject to any disclaimer, the term of this patent is extended or adjusted under 35 U.S.C. 154(b) by 0 days.

(21) Appl. No.: 09/447,332

(22) Filed: Nov. 22, 1999

Related U.S. Application Data

(60) Provisional application No. 60/109,571, filed on Nov. 23, 1998, and provisional application No. 60/129,824, filed on Apr. 16, 1999.

(51) Int. Cl.[7] ..... A47K 3/34
(52) U.S. Cl. ..... 4/608; 4/558
(58) Field of Search ..... 4/558, 608

(56) References Cited

U.S. PATENT DOCUMENTS

| | | | | |
|---|---|---|---|---|
| 1,732,798 A | | 10/1929 | Falzer | |
| 2,465,853 A | | 3/1949 | Dalton | |
| 2,481,397 A | | 9/1949 | Dalton | |
| 2,756,438 A | | 7/1956 | Soberman | |
| 2,840,827 A | | 7/1958 | Calvano | |
| 3,050,742 A | | 8/1962 | Munson | |
| 3,208,083 A | | 9/1965 | Witczak | |
| 3,222,689 A | | 12/1965 | Efron | |
| 3,582,998 A | | 6/1971 | Morse | |
| 4,122,559 A | | 10/1978 | Kelly | |
| 4,286,343 A | | 9/1981 | Lampka | |
| 4,916,764 A | | 4/1990 | Meaden | |
| 5,575,022 A | * | 11/1996 | Duffy et al. | 4/607 |

* cited by examiner

*Primary Examiner*—Charles E. Phillips
(74) *Attorney, Agent, or Firm*—Wendy M. Lee

(57) ABSTRACT

Closure devices for shower enclosures are provided which allow for a means for increasing the showering area in a shower enclosure and/or facilitate replacement of a shower screen.

3 Claims, 18 Drawing Sheets

DETAIL A

SHOWER SCREENS

This is a non-provisional application filed under 37 CFR 1.53(b) claiming priority to provisional application No. 60/109,571 filed Nov. 23, 1998, and provisional application 60/129,824 filed Apr. 16, 1999, the contents of both of which are incorporated herein by reference.

FIELD OF THE INVENTION

The present invention relates to a shower screen unit for use with a bath or shower.

BACKGROUND

Throughout history, a number of devices have been developed which function to prevent water escaping out of the open face or faces of a shower or bath enclosure. Such devices include flexible shower screens formed from waterproof fabric which are attached to a horizontally mounted rail and can be drawn across the open face of the bath or shower. Alternatively, shower doors formed from plastic or glass are widely used. Such shower doors are generally opened and closed via a hinge or sliding mechanism.

The present invention, on the other hand, lies in-between such aforementioned devices, and provides a semi-rigid slideable screen with desirable features from an operating and maintenance perspective. These features will be elaborated in more detail herein.

SUMMARY OF THE INVENTION

The present invention pertains to a closure device for a shower enclosure comprising a shower entrance surround and a replaceable shower screen assembly for use in combination, the shower entrance surround comprising a housing for containing the shower screen assembly, which housing is vertically mounted in the shower enclosure in use, the housing having a door for providing access to the interior thereof such that the shower screen assembly can be replaced and further providing mounting means for engaging the shower screen assembly; a top rail and a bottom rail; and engagement means mounted opposite the housing in use, wherein the engagement means is capable of retaining the shower screen in a closed position in use; and the shower screen assembly comprising a spring loaded roller with a shower screen attached thereto, wherein the spring is pre-wound to an appropriate tension for the dimensions of the shower enclosure.

Thus, the shower screen assembly can be replaced with a new shower screen assembly that is correctly tensioned for immediate use to the desired width and/or height of the shower opening with which it will be used.

The invention also relates to an article of manufacture comprising a shower screen assembly, which shower screen assembly comprises a spring loaded roller with a shower screen attached thereto, wherein the spring is pre-wound to an appropriate tension for the dimensions of the shower enclosure, and further comprising instructions for installing the shower screen assembly in a housing in use.

In yet another embodiment, the invention provides a closure device for a shower enclosure comprising a housing for containing a shower screen, wherein the housing is vertically mounted in use; a top rail and a bottom rail, wherein either the top rail or the bottom rail, or both, comprise at least one curve; and an engagement means capable of retaining the shower screen in a closed position in use.

The invention further pertains to a closure device for a shower enclosure comprising a pair of housings which each contain a shower screen therein, wherein the housings are vertically mounted in use; at least one top rail and at least one bottom rail; and a single, elongate vertically mounted engagement means capable of retaining both shower screens in a closed position in use.

BRIEF DESCRIPTION OF THE DRAWINGS

The invention will now be described by way of example only, with reference to the accompanying drawings, wherein.

DESCRIPTION OF THE PREFERRED EMBODIMENT OF THE INVENTION

Figure 1:
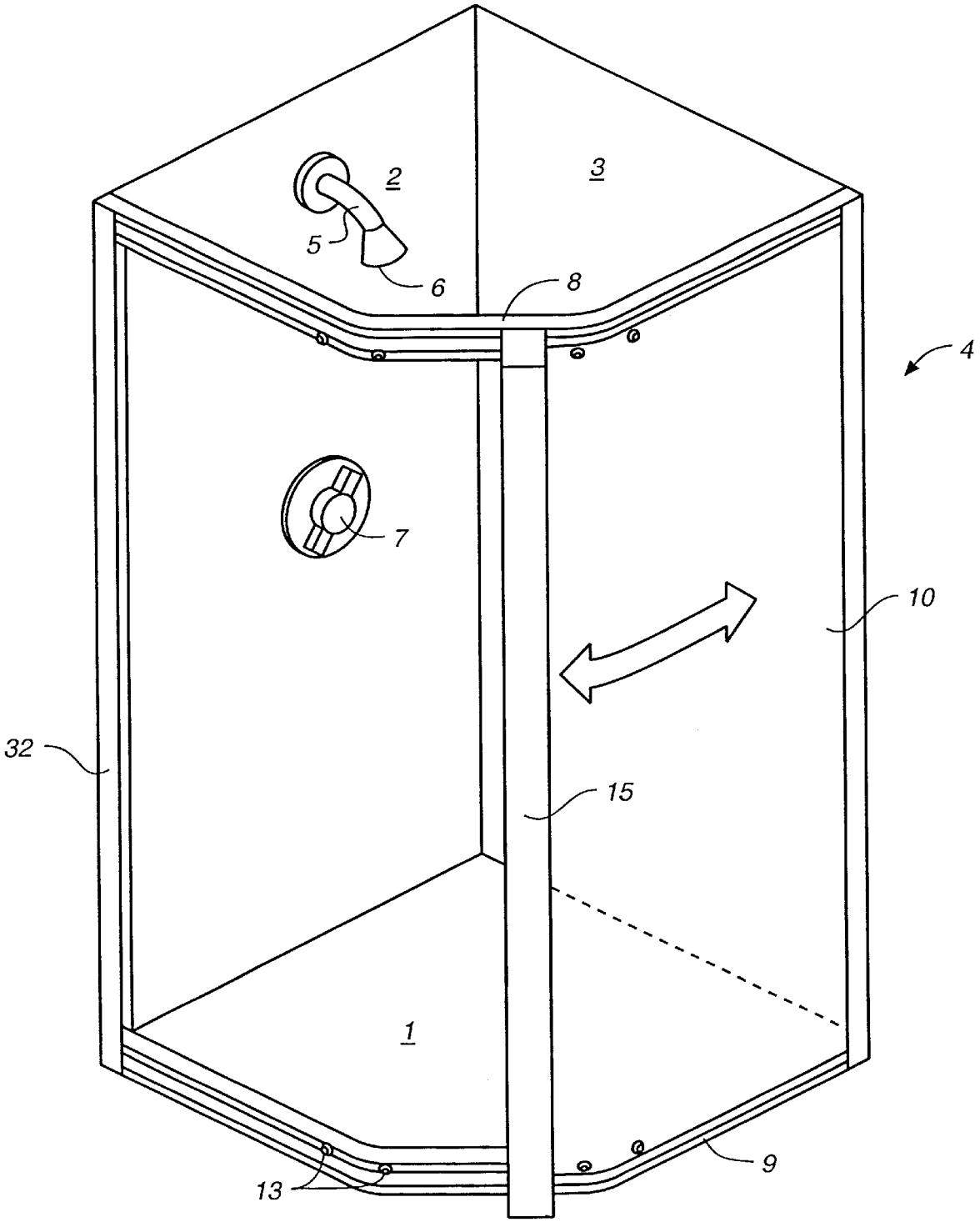
FIG. 1 is a front perspective view of a closure device according to one embodiment of the invention.

Definitions:

When used throughout this specification, these terms will have the following definitions, unless indicated otherwise:

"Closure device" refers to an apparatus which, in use, reduces or prevents water escaping through the open face or faces of a shower enclosure. In one embodiment, the closure device comprises. a "shower entrance surround" and a "replaceable shower screen assembly" which, when assembled together, form the closure device. Such shower entrance surround and replaceable shower screen assembly may be packaged together or packaged separately. Moreover, the replaceable shower screen assembly may be sold separately with instructions for using this assembly with the shower entrance surround or vice versa.

By "shower enclosure" is meant a shower which is at least partially enclosed, having at least one defined, open face, including showers which are mounted over or in baths and therefore have one or more open faces depending upon the location of the bath.

The "shower entrance surround" is mounted in the shower enclosure and houses the replaceable shower screen assembly in use. The shower entrance surround comprises (a) a housing for containing the shower screen assembly; (b) a top rail for supporting the upper edge of the shower screen, and/or a support member attached thereto, in use; (c) a bottom rail for supporting the lower edge of the shower screen, and/or a support member attached thereto, in use; and (d) engagement means, for retaining the shower screen in a closed position in use. While each of (a)–d) are preferably separate components which are individually fitted in the shower enclosure, in one embodiment of the invention, (a)–(d) may be combined together (erg. (a), (b), (c) and/or (d) may be molded together as one or more units).

The term "replaceable shower screen assembly" when used herein refers to the shower screen which is able to cover an open face of the shower enclosure, and its attachments which facilitate replacement of one shower screen assembly with another such assembly. In this embodiment, the roller to which the shower screen is attached is spring-loaded and the spring is pre-wound to an appropriate tension for the dimensions of the shower enclosure. Hence, a used shower screen assembly can be removed from the shower entrance surround when the user of the closure device desires to replace the screen and a new shower screen assembly can be assembled with the shower entrance surround.

The present invention will now be described with reference to the accompanying drawings.

FIGS. 1–5 depict an embodiment of the invention where the closure device may be used in association with a shower enclosure where the distance 1 between the walls 2 and 3 in which the closure device is mounted is substantially less that the width of the mounted closure device, such that the closure device serves to effectively increase the space inside the shower enclosure, so that the person showering has more room to move inside the shower enclosure.

In FIG. 1, the shower enclosure 4 is in the form of a shower box mounting a water pipe 5 and a shower rose 6, together with suitable control means 7.

The closure device comprises a housing 15 for containing a shower screen 10. If desired, the housing 15 can run substantially the height of the opening of the shower enclosure or can be of any desired length. The housing 15 is positioned substantially vertically in use (slight deviations from vertical are, of course, contemplated).

The shower screen 10 is formed from a suitable material such that it is substantially flexible (ie. able to be wound around a roller 16), yet is denser or more rigid than a conventional shower curtain, such that it remains substantially taut over essentially its entire surface area when it is extended across the shower opening and held in place under spring tension. Preferably the shower screen 10 is formed from a polyester material. Suitable materials for forming the screen include MYLAR® manufactured by DuPont, USA; and MELINEX® (ICI, UK). The material may be translucent and/or transparent and may have patterns or coatings therein or thereon, as desired. For example, designs, logos, etc may be screen-printed onto the shower screen 10.

The shower screen 10 is preferably attached along one edge thereof to a roller 16 and is wound around the roller 16. For example, the edge of the shower screen 10 may be attached to the roller 16 using a suitable adhesive. Alternatively, a slot may be provided in the roller 16 for retaining the shower screen 10 thereto. In yet another embodiment, a screw, pin, nail or such like may be used to secure the shower screen 10 to the roller 16. The roller 16 is spring loaded or biased. In another embodiment, the shower screen 10 is heat-treated polyester, thus obviating the need for a biased roller 16, as heat-treated polyester has inherent biasing properties.

Figure 2:
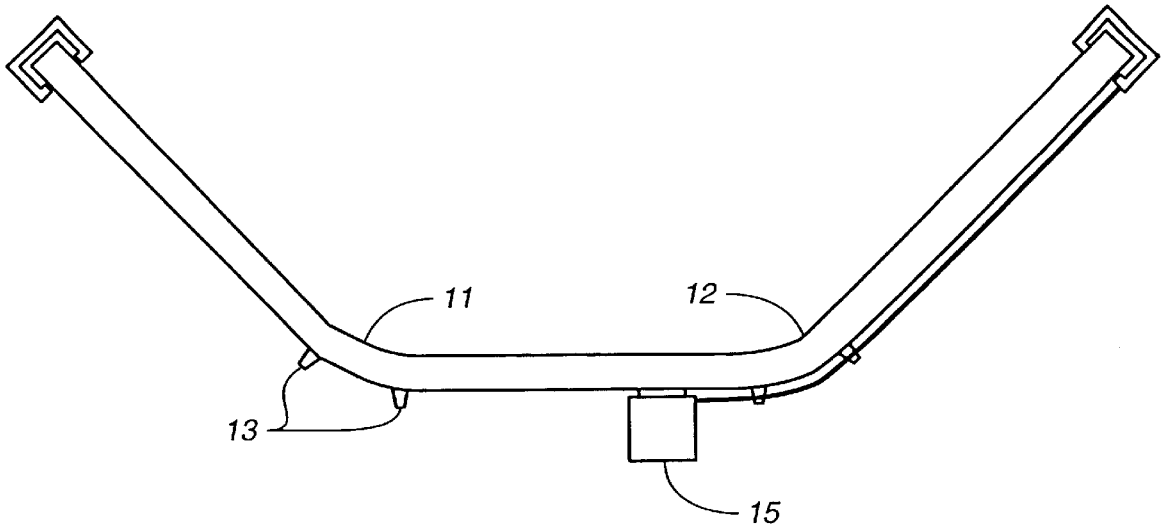
FIG. 2 is a plan view of the closure device of FIG. 1.
Figure 3:
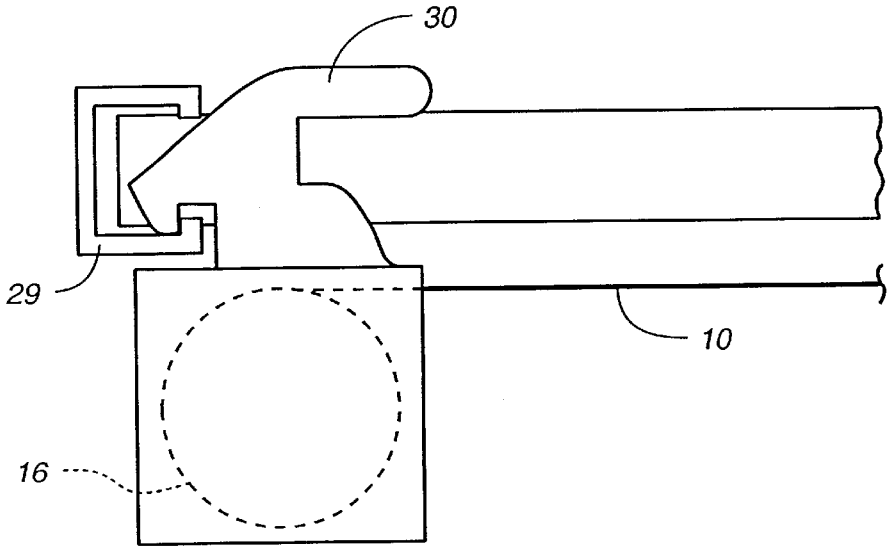
FIG. 3 is a plan view of an engagement means for use with the closure device of FIG. 1.

The closure device provides a top rail 8 and bottom rail 9 for supporting upper and lower edges, respectively, of the shower screen 10 and/or the housing 15 shown in FIGS. 1–3. In the embodiment of FIGS. 1–3 and 5, the top rail 8 or the bottom rail 9, and preferably both the top rail 8 and the bottom rail 9, comprise at least one curve. Therefore, the rails 8 and 9 curve outwardly from the shower enclosure 4 thus effectively increasing the space for showering.

Figure 5:
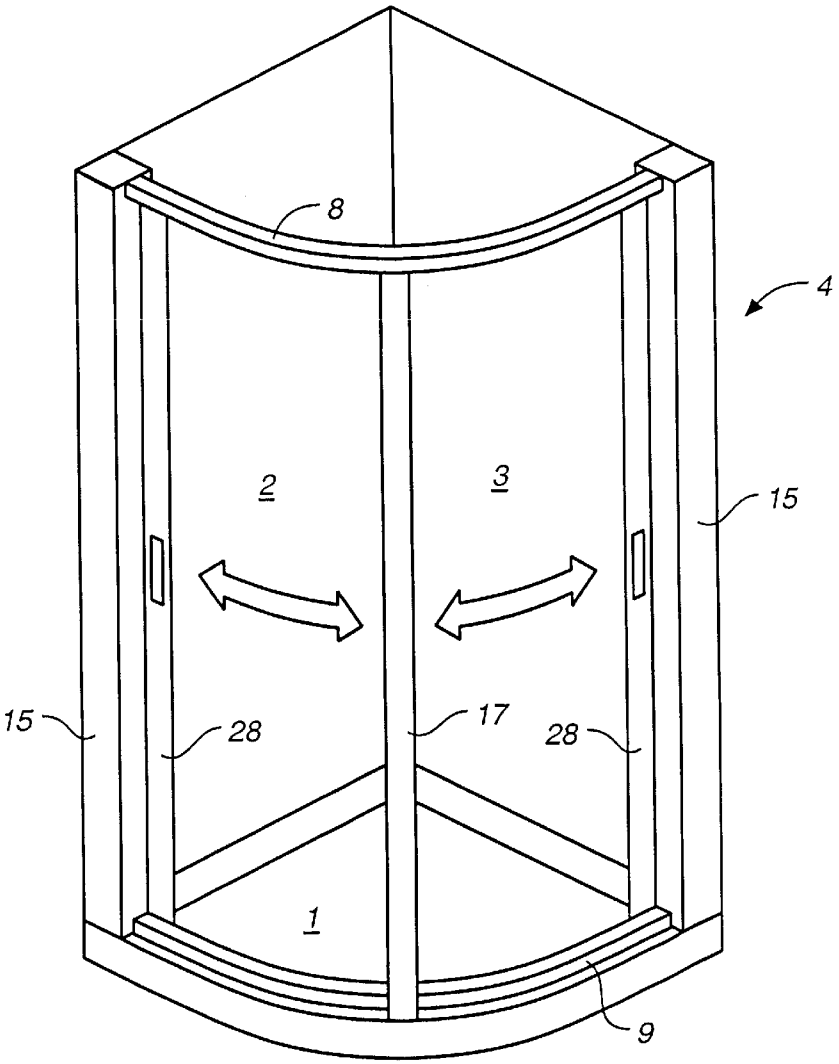
FIGS. 4 and 5 are perspective views of closure devices according to further embodiments of the invention.

The top rail 8 and/or the bottom rail 9 may, for example, comprise a pair of curves 11 and 12, thus providing an irregular pentagon-shaped rail as shown in FIG. 2. Other rail configurations are contemplated, such as semi-circular as shown in FIG. 5, for example. The top rail 8 or bottom rail 9, or both, may provide retaining means for retaining the upper or lower edge, respectively, of the shower screen 10 to the rail when the shower screen 10 is closed. In FIGS. 1 and 2, the retaining means comprises a plurality of knobs 13 attached to, or integral with, the rail 8 or 9. Corresponding holes are provided in upper and lower edges of the shower screen 10. In this embodiment, the upper and lower edges of the shower screen 10 run outside the rails 8 and 9. As the rolled-up shower screen 10 in the housing 15 is pulled across the open face of the shower enclosure 4, the knobs 13 will insert into holes 14 and thereby retain the shower screen 10 to the rails 8 and 9. This way, the retaining means prevents the shower screen from encroaching on the showering area inside the rails 8 and 9. In an alternative embodiment, the retaining means for retaining the shower screen 10 to a rail 8 or 9 comprises a seam at the top edge and/or bottom edge of the shower screen 10 which rides inside grooves in the top rail 8 and/or bottom rail 9, respectively. In yet a further embodiment, the shower screen 10 runs outside the top rail 8 and/or the bottom rail 9 and friction between the rail 8 and/or 9 and shower screen 10 prevents the shower screen 10 from encroaching on the showering area.

The closure device further comprises an engagement means, e.g. a vertically mounted bar 32 providing a groove 29 for engaging a location means on or attached to the shower screen 10, such as a clip 30 provided on, or integral with the housing 15 as shown in FIG. 3.

Figure 4:
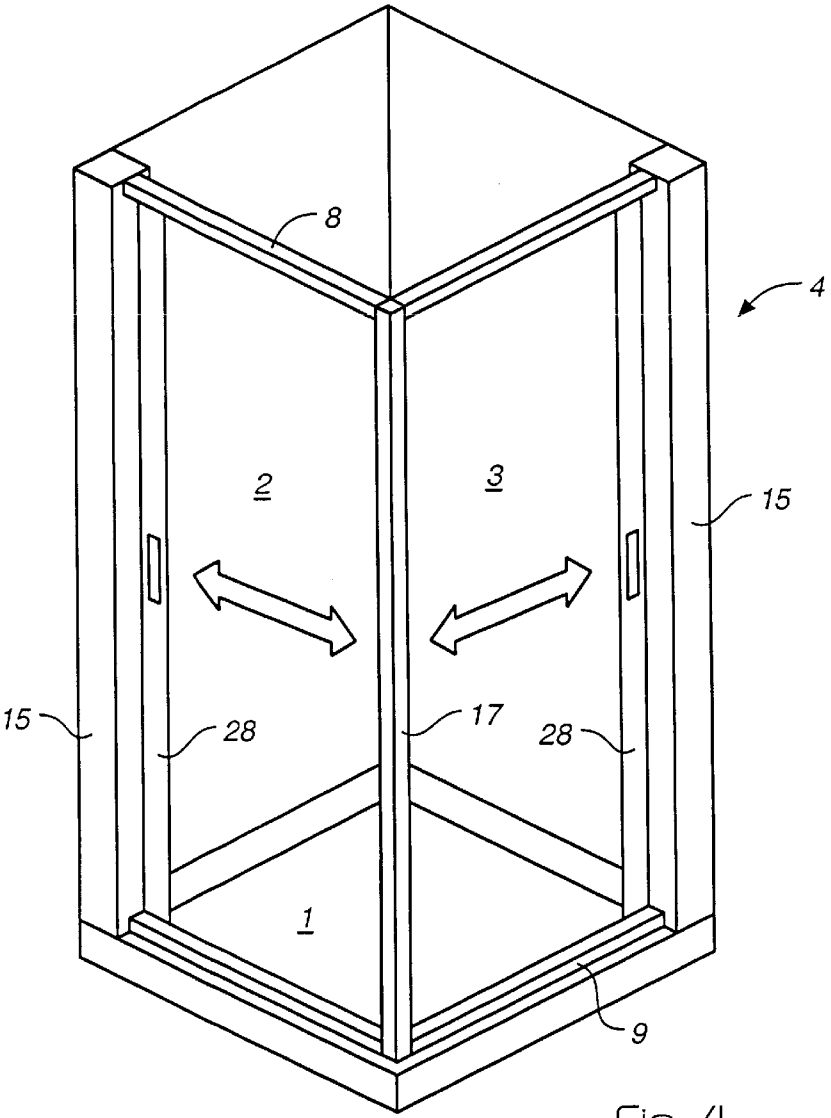
Figure 6:
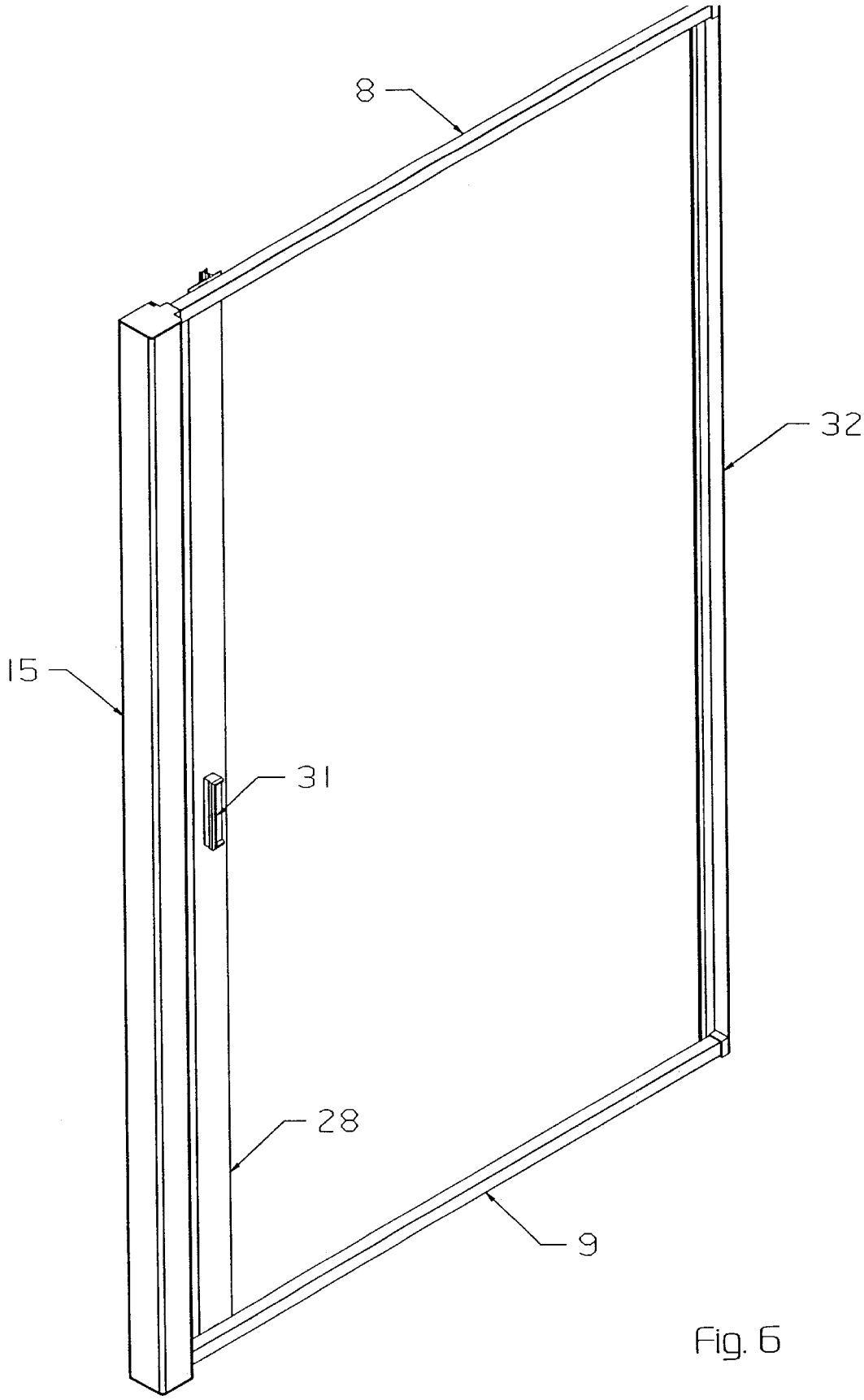
FIG. 6 is a front perspective view of a closure device, with the shower screen open.

FIGS. 4 and 5 depict alternative embodiments of the present closure device, particularly adapted to a shower enclosure with only two side walls, 2 and 3. In the embodiments shown, a pair of shower screens 10 within a pair of housings 15 are mounted on walls 2 and 3, and both shower screens 10 engage a single engagement means (e.g. an elongate, vertical center pole 17) which retains the pair of shower screens 10 in a closed position in use. For example, the shower screens 10 may engage the center pole 17 via location means in or on support member 28. Such closure devices, like the device in FIGS. 1–3, also serve to increase the effective showering space.

Thus, in the embodiment of the invention shown in FIGS. 1–5, a shower screen is shown which can be used to increase the showering area when the shower screen is closed. This is particularly useful where the space for the shower is limited, e.g. in a campervan or mobile home.

FIGS. 6–23 show more clearly componentry of a shower enclosure comprising a shower entrance surround (shown generally in FIG. 19) and a replaceable shower screen assembly (see, e.g., FIG. 13) for use in combination. This system may be combined with that described above with reference to FIGS. 1–3 and 5, such that the shower screen assembly is replaceable and either the top rail 8, or the bottom rail 9, or both, comprise at least one curve. Alternatively, or additionally, the invention contemplates a pair of replaceable shower screen assemblies which each engage a single engagement means in use (see FIGS. 4 and 5).

Figure 18:
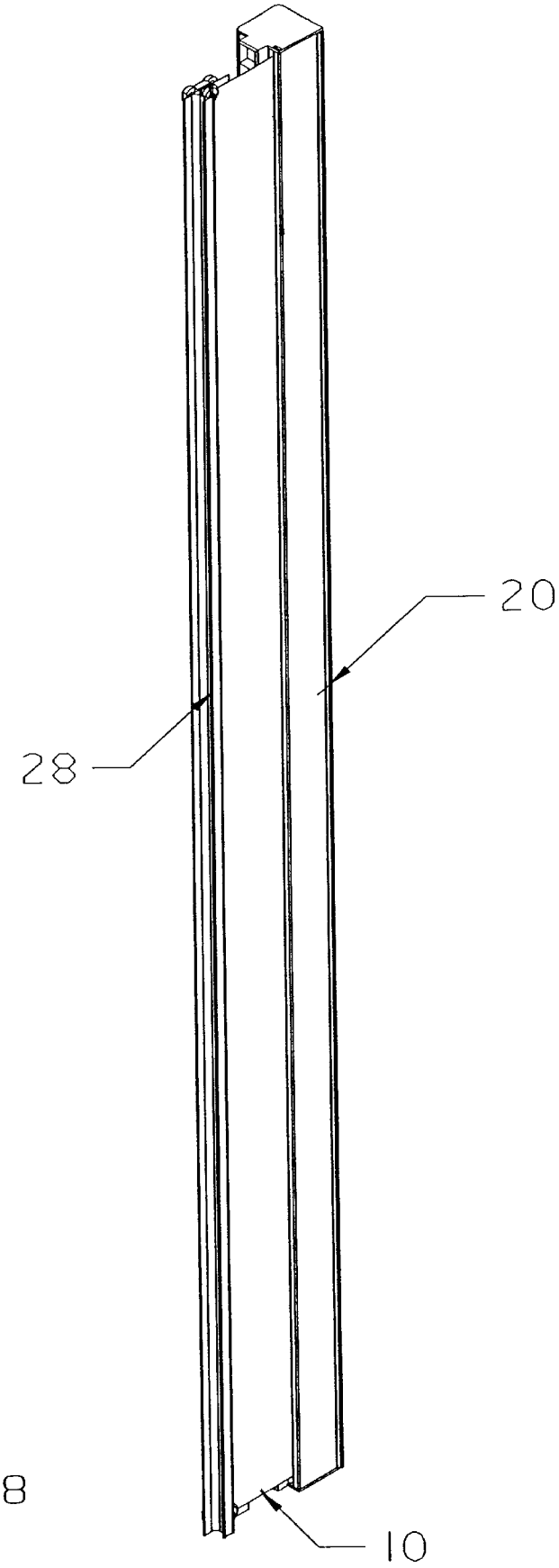
FIG. 18 is a view of FIG. 16 with the door closed and the shower screen assembly ready for use.

The shower entrance surround comprises a housing 15 in which the replaceable shower screen assembly is installed. The housing is substantially vertically mounted in use. While the housing 15 may be molded as a single unit, generally, it is a multi-component device. The housing 15 comprises a door 20 which can be opened so as to provide access to the interior of the housing 15, such that the shower screen assembly can be replaced. Following replacement of the shower screen assembly, the door 20 may be closed (e.g. as depicted in FIG. 18). In one embodiment, the door 20 runs essentially the full height of the housing and has an integrated hinge 21 (see FIG. 19).

Figure 19:
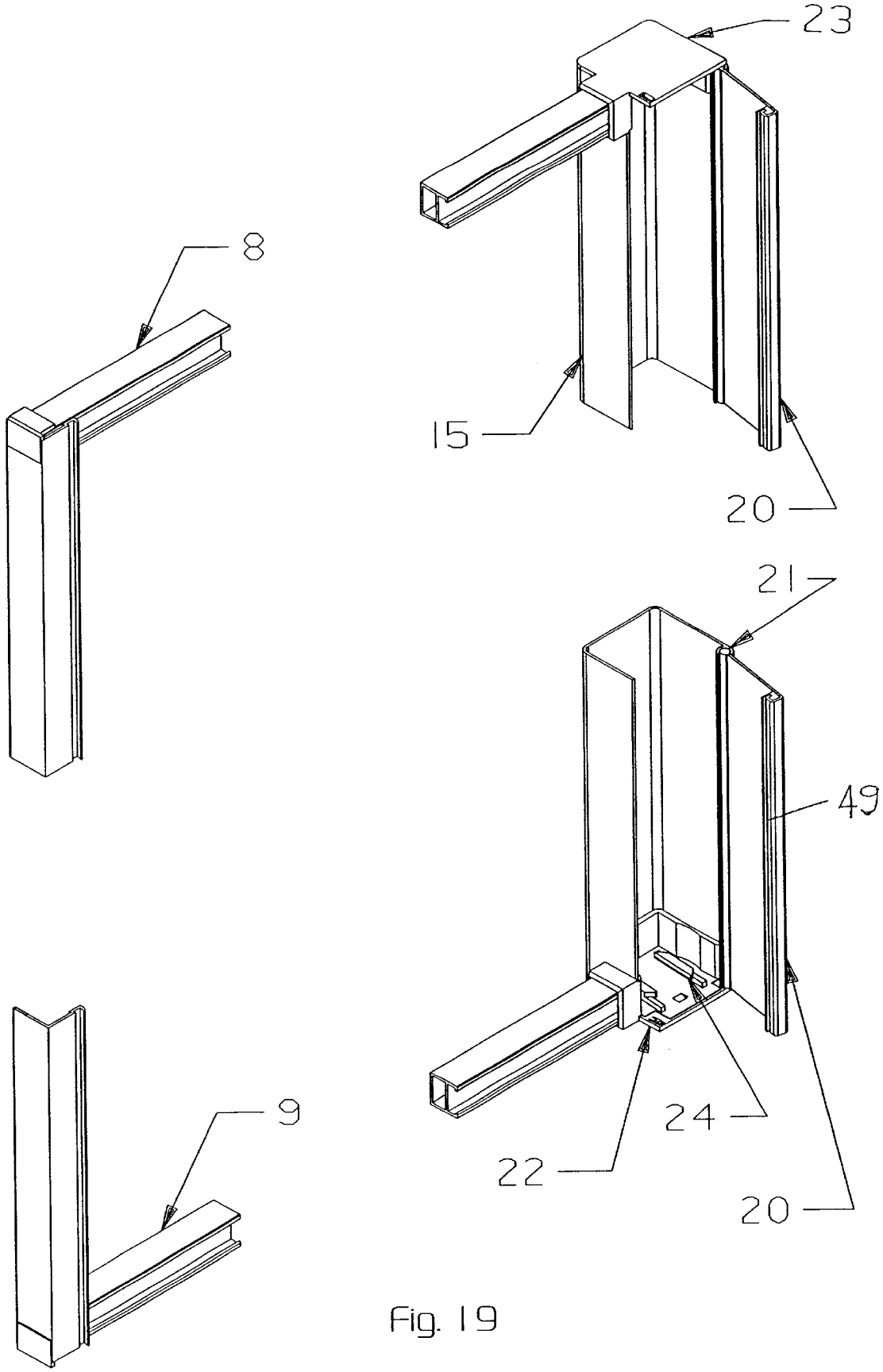
FIG. 19 is a rear perspective cut away view of a shower entrance surround with the door open to allow installation of the replaceable shower screen assembly.

The housing 15 further provides mounting means for engaging the shower screen assembly. For example, as shown in FIG. 19, the mounting means may comprise one or more slots 24 provided in cap 22 and/or a spigot on cap 23 around which the roller 16 revolves. Caps 22 and 23 are considered to be part of the housing 15. Moreover, caps 22 and/or 23 may be molded with a curve or other shapes as desired to facilitate installation of the housing 15 in a shower enclosure having a corresponding curved edge which abuts the upper and/or lower edge of the housing 15.

Figure 7:
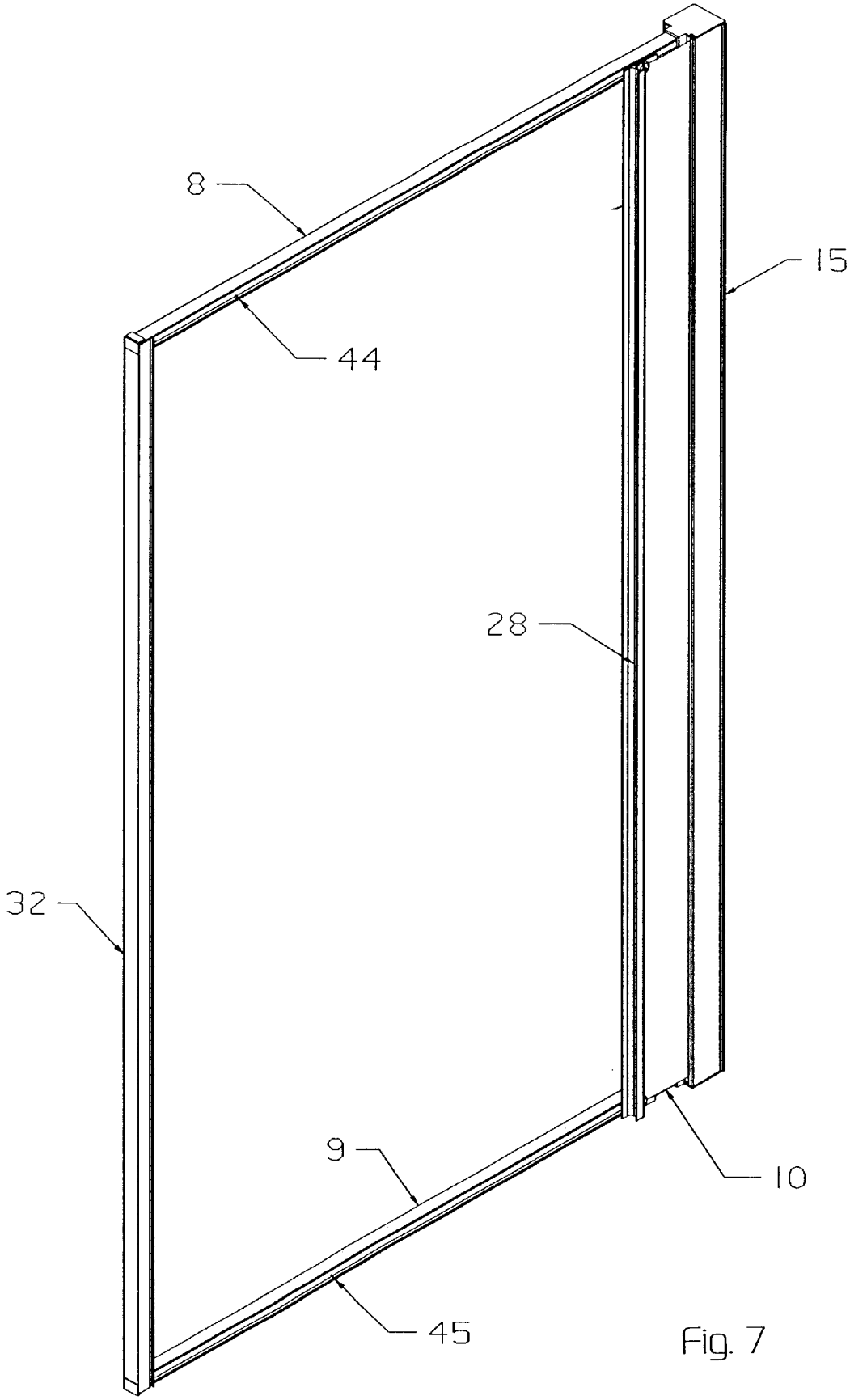
FIG. 7 is a rear perspective view of a closure device, with the shower screen open.
Figure 8:
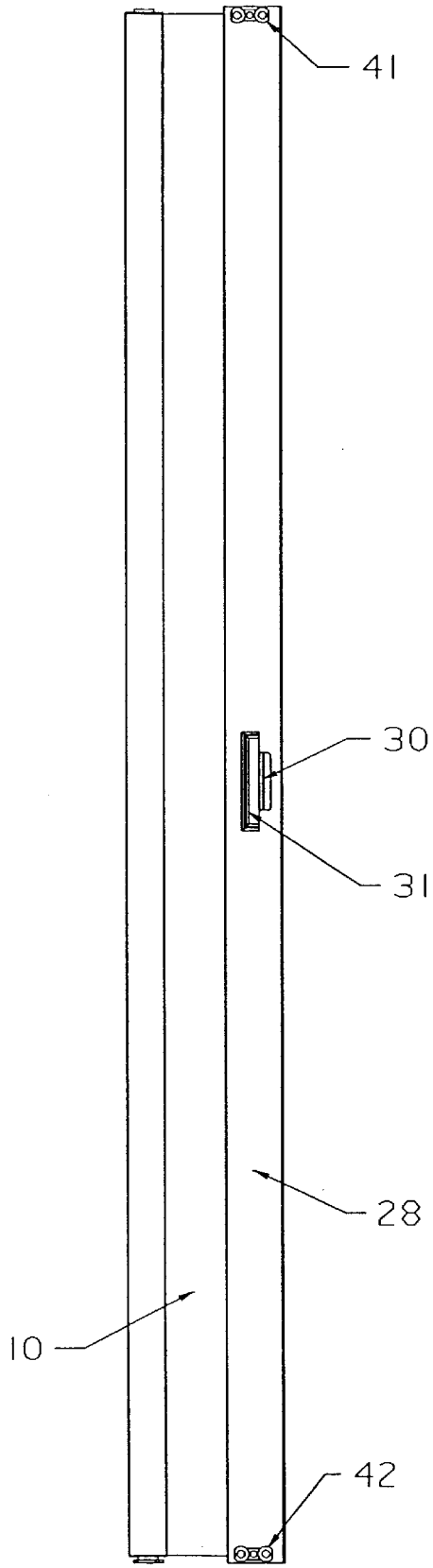
FIG. 8 is a front view of a replaceable shower screen assembly.
Figure 9:
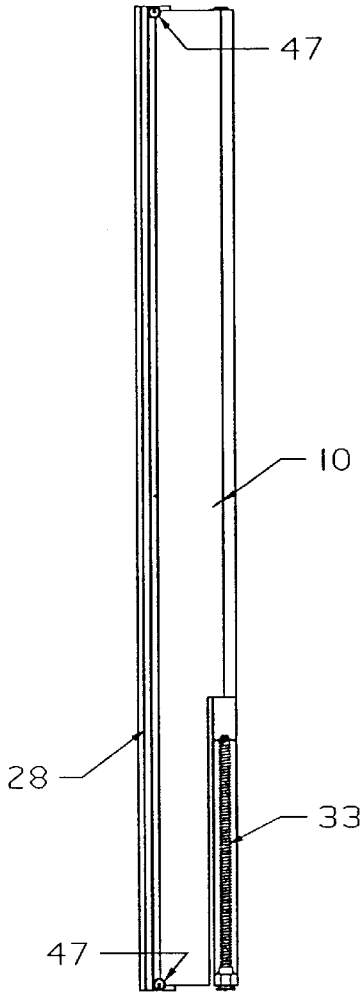
FIG. 9 is a front view of a replaceable shower screen assembly, with cut away spring detail.
Figure 10:
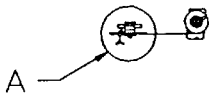
FIG. 10 is a plan view of the replaceable shower screen assembly of FIG. 9.

The shower entrance surround also comprises a top rail 8 and a bottom rail 9 for supporting upper and lower edges, respectively, of the shower screen 10 screen and/or support member 28 attached thereto. The support member 28 preferably provides one or more guide members (e.g. top guide member 41 and bottom guide member 42 as shown in FIG. 8) which ride in one or more grooves provided in the shower entrance surround (such as grooves 44 and 45 in top and bottom rails 8 and 9, respectively, as shown in FIG. 7).

Finally, the shower entrance surround provides some form of engagement means for engaging the shower screen 10. The engagement means is generally mounted opposite the housing 15 in use. In one embodiment, the engagement means comprises a vertically mounted bar 32 with a groove 29 (FIG. 20) for engaging a corresponding clip 30 (see FIG. 8) provided on the shower screen, e.g. integrally molded with handle 31 attached to support member 28.

Figure 21:
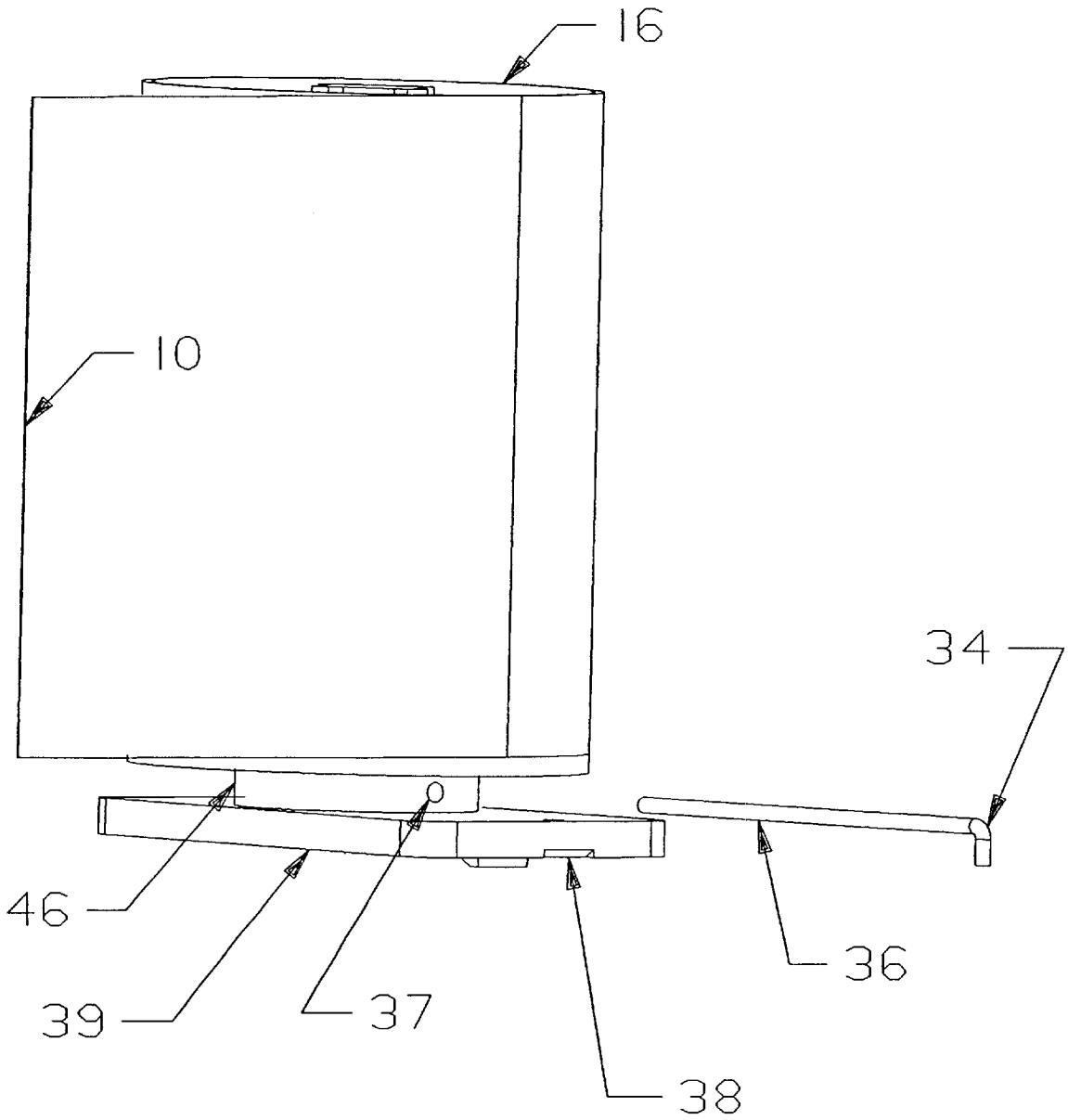
FIG. 21 is a detailed view of a locking mechanism for the replaceable shower screen assembly.
Figure 22:
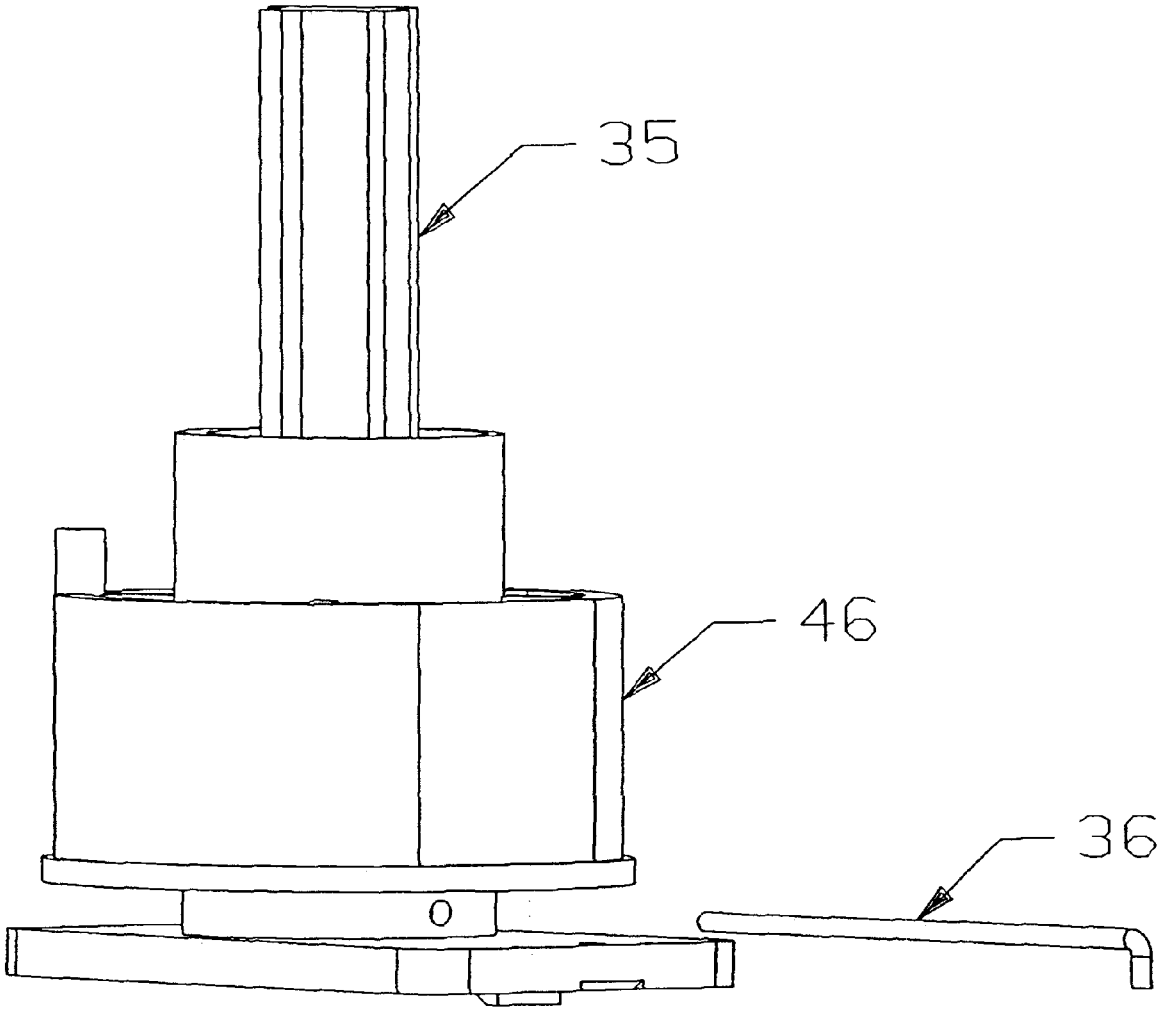
FIG. 22 is a view of FIG. 21 lacking the roller 16, shower screen 10 and spring 33 to reveal the roller bearing 46 and locking pin 36 which goes through the roller bearing 46 and spring shaft 35 to lock the two together to hold spring tension.

Turning now to the replaceable shower screen assembly shown with particularity in FIGS. 8 to 13 as well as FIGS. 21 and 22, this comprises a roller 16 with a shower screen 10 attached thereto. The shower screen 10 is attached to and wound around the roller 16. The roller 16 is spring loaded and the spring is pre-wound to an appropriate tension to suit the dimensions (width and/or height) of the opening in the shower enclosure in which the closure device will be positioned in use. Such "appropriate tension" ensures the shower screen 10 is able to be drawn taut across the open face(s) of the shower enclosure when closed, yet readily retracts into the housing 15 when opened by the user of the device. Appropriate tension can be achieved by providing a spring 33 on a spring shaft 35 inside the roller 16 and winding the roller 16 (with attached shower screen 10) a pre-selected number of turns of tension depending on the width and/or height of the opening in the shower enclosure with which the closure device is intended to be used. For example, for a 925 mm wide×1500 mm high shower enclosure opening, 11 turns of tension has found to be appropriate; for 1500 mm wide×1700 mm high shower enclosure opening, 16 turns of tension may be appropriate; and for 1500 mm wide×1500 mm high shower enclosure opening, one may use 15 turns of tension to pre-wind the shower screen assembly to an appropriate tension.

The shower screen assembly preferably further comprises a locking mechanism for maintaining the pre-wound tension until the shower screen assembly has been installed and is ready for use. This locking mechanism may be deployed at this time to release the shower screen 10 and activate the spring 33. The locking mechanism may comprise a locking pin 36 positionable in an appropriately dimensioned aperture 37 in the roller bearing 46 as well as a further appropriately dimensioned aperture 38 in the end plate 39 or the spring shaft 35 of the shower screen assembly. Thus, the locking pin 36 comprises a curve 34. The roller bearing 46 is attached to the shower screen 10 by a screw, rivet, nail or other attachment means. Essentially, the roller bearing 46 is locked to the spring shaft 35 or end plate 39 by pin, clamp, clip or some other mechanical means to maintain the desired spring tension.

Thus, once the shower screen assembly has been pre-wound to an appropriate tension, the locking pin 36 is inserted in the aperture 37 in the roller bearing 46 through spring shaft 35 and in aperture 38 in the end plate 39 to lock the roller bearing 46 and attached roller 16 to the end plate 39 and spring shaft 35 and hold the pre-wound tension until the shower screen assembly is fitted into the housing 15.

An additional removable fastener such as a tape, cord, adhesive strip or the like may be fastened around the roller 16 and support member 28 to hold the shower screen assembly together to avoid the shower screen 10 unwinding prior to the shower screen assembly being installed in the housing 15. Once the shower screen assembly has been fitted into the housing 15, the fastener can be removed.

To install the shower screen assembly in the housing, the roller 16 is fitted to a spigot on cap 23 and the end plate 39 of the shower screen assembly is slotted in bottom cap 22 and retained by slots 24. Then, the locking pin 36 which locks the roller bearing 46 and roller 16 is removed, allowing the roller 16 to rotate and the spring 33 to function. The shower screen 10 is then under tension and after being pulled out from the housing 15 via the handle 31, will retract of its own accord back into the housing 15.

Figure 11:
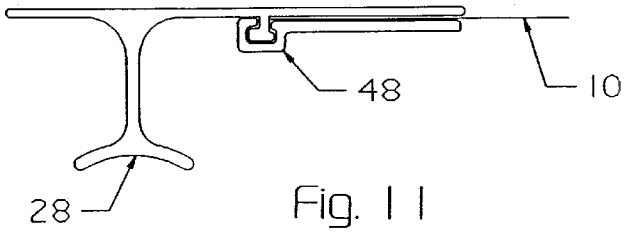
FIGS. 11 and 12 are exploded views of detail A in FIG. 10 and depict alternative embodiments for attaching a support member to the shower screen. These figures show that the support member 28 may be pre-attached to the replaceable shower screen or a used support member 28 may be attached to a replacement shower screen assembly by the end user thereof.

With particular reference to FIGS. 9–12, the replaceable shower screen assembly may provide a location means for co-operating with the engagement means of the shower entrance surround to retain the shower screen 10 in a closed position in use. For example, the leading edge of the screen 10 may be attached to rigid elongate support member 28 by one or more clips 47 or the like (see FIG. 12). In another embodiment, a means for attaching support member 28 to the leading edge of the screen may be provided with the replaceable screen assembly. For example, the attachment means may comprise an elongate rigid clip 48 capable of engaging a support member 28 (FIG. 11).

Figure 20:
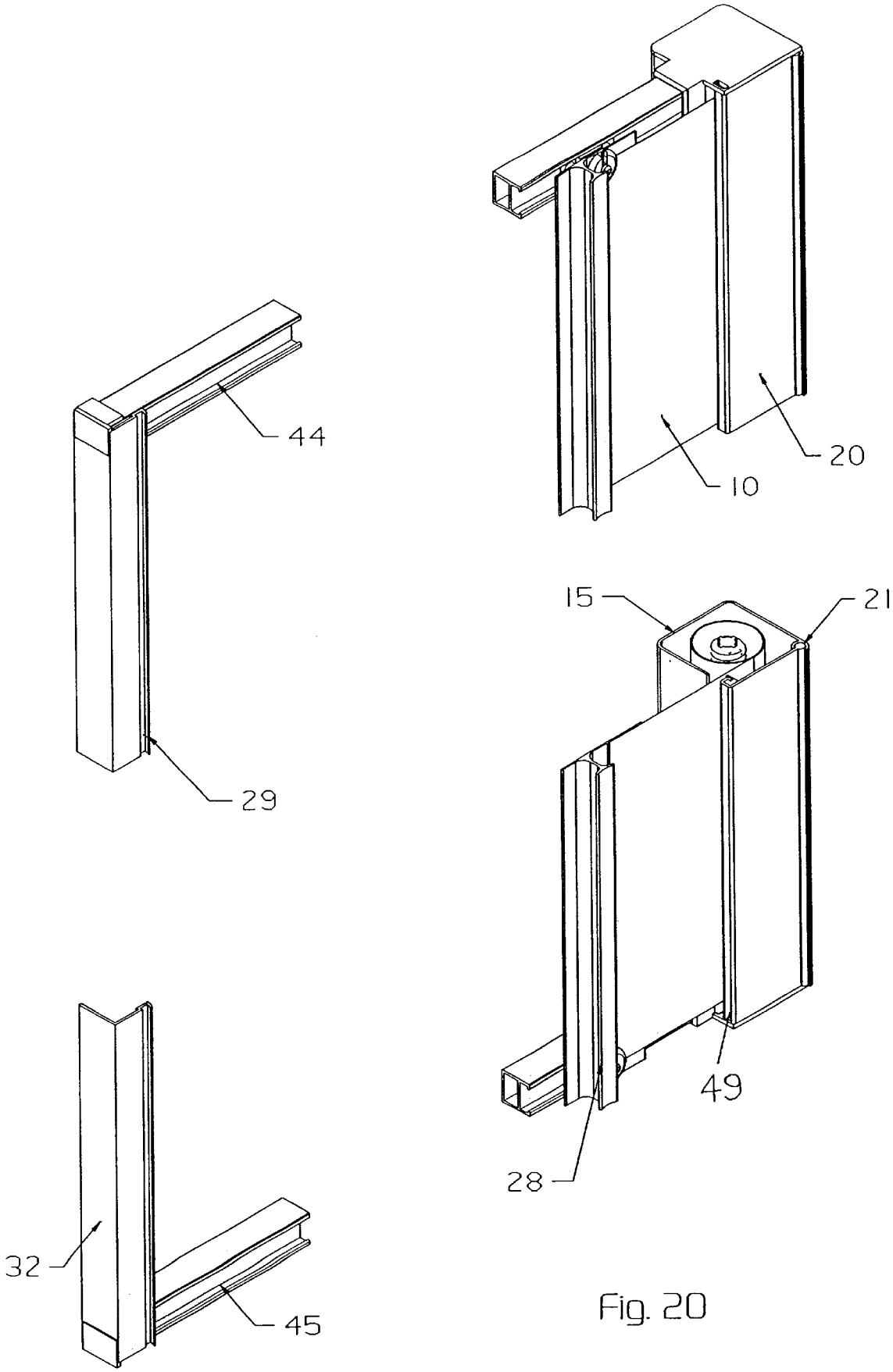
FIG. 20 is a view of the FIG. 19 shower entrance surround with the replaceable shower screen assembly installed and the shower screen partially extended.

In one embodiment, the housing 15 further comprises a means for squeegee cleaning the shower screen 10 when the latter is rolled back into the housing 15. This member preferably runs essentially the entire height of the housing 15 and/or shower screen 10. In the embodiments of FIGS. 19 and 20 the squeegee cleaning member 49 comprises an elongate member which is fitted around the edge of the door 20. This squeegee cleaning member removes excess water from the shower screen 10 when it is retracted into housing 15.

Figure 12:
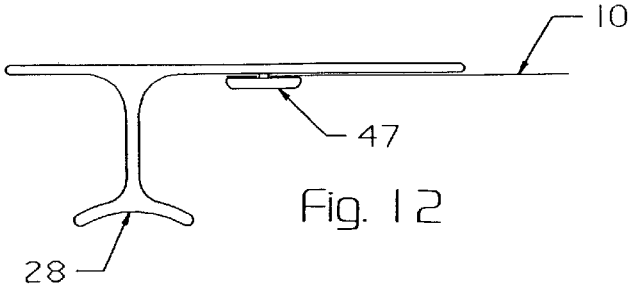
Figure 13:
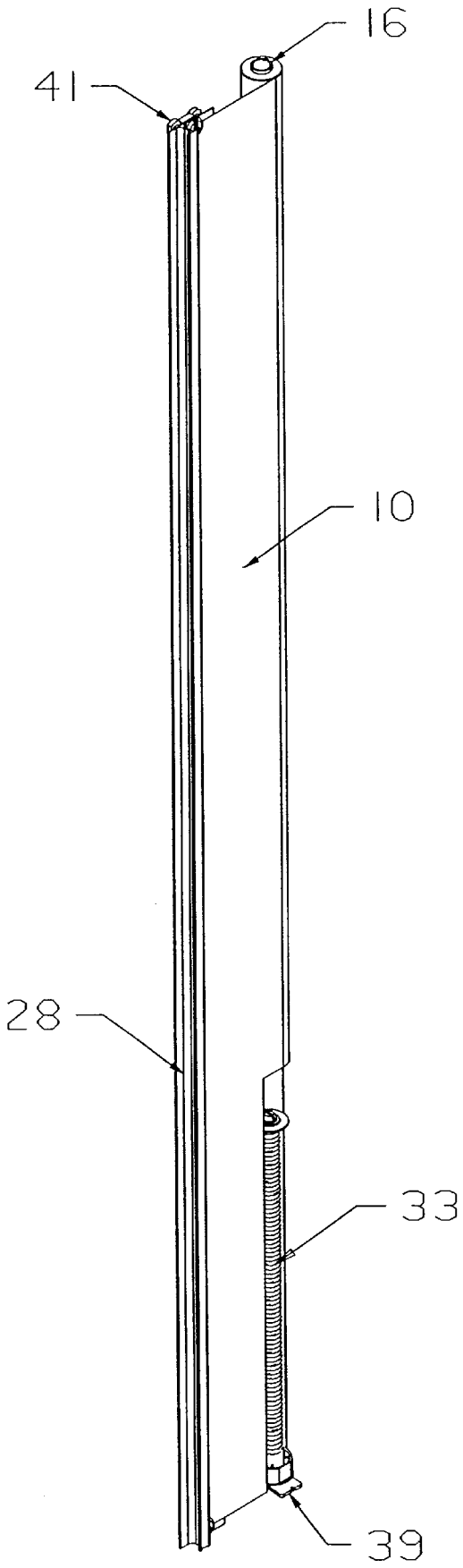
FIG. 13 is a rear perspective view of the replaceable shower screen assembly with cut away spring detail.
Figure 14:
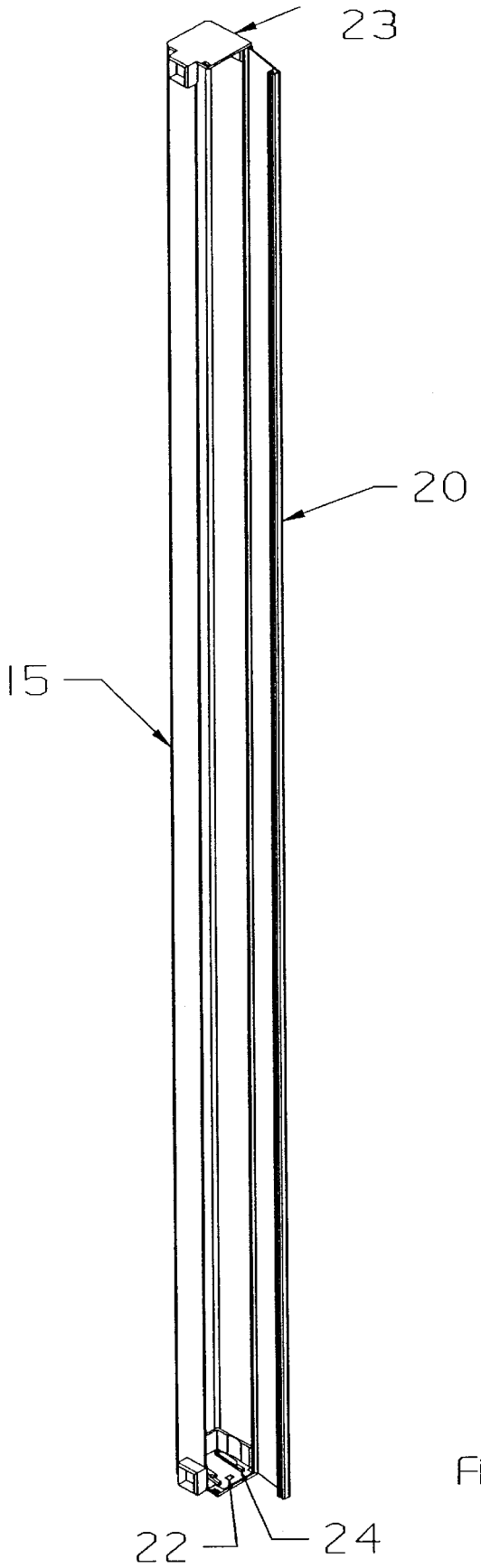
FIG. 14 is a rear perspective view of a housing, with the door opened to facilitate installation of a replaceable shower screen assembly therein.
Figure 15:
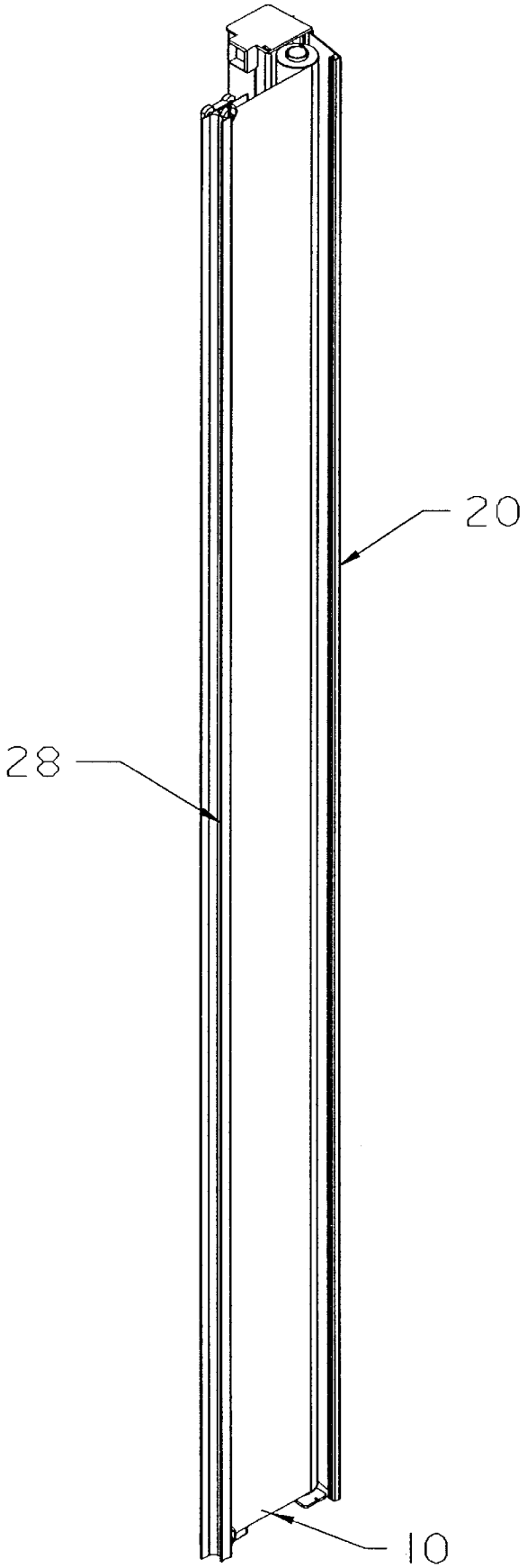
FIG. 15 depicts the housing of FIG. 14 with the replaceable shower screen assembly being installed therein.
Figure 16:
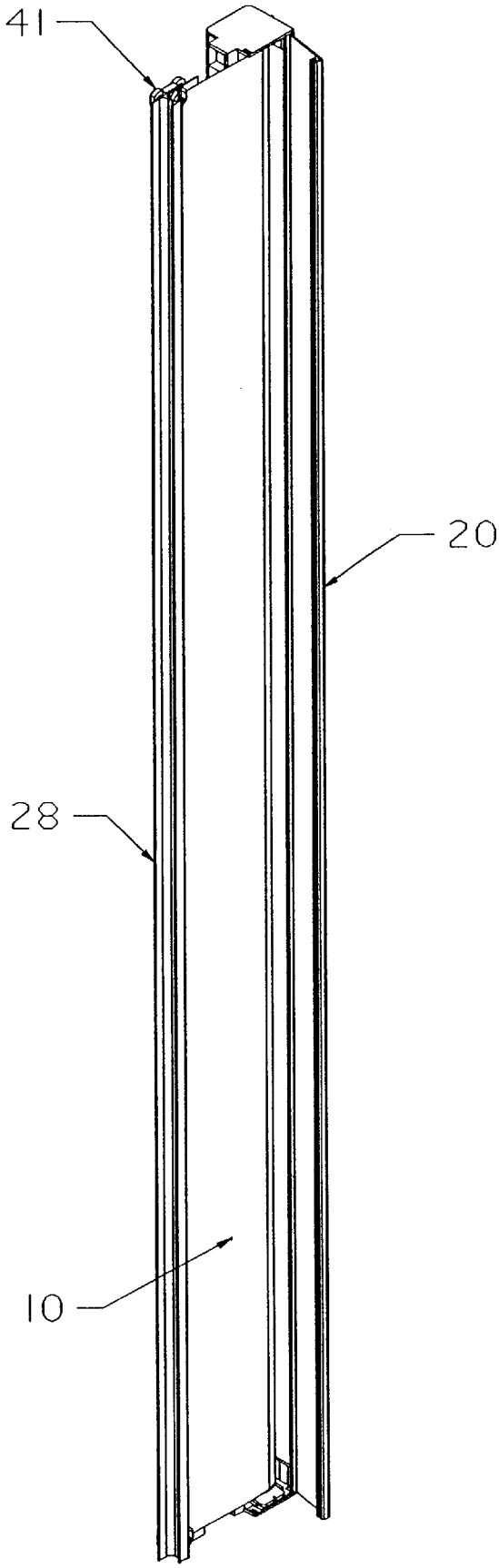
FIG. 16 is a further view of the housing of FIG. 14, with the replaceable shower screen assembly completely installed therein and door open.
Figure 17:
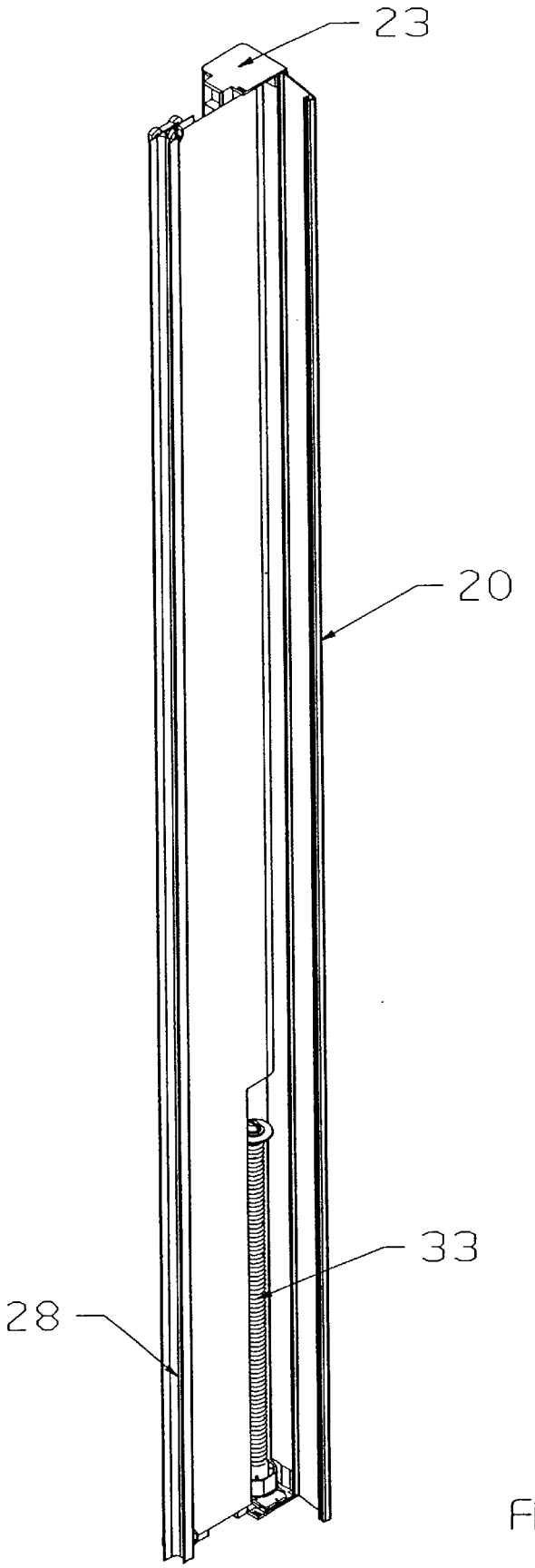
FIG. 17 is a view of FIG. 16 with a cut away spring detail.
Figure 23:
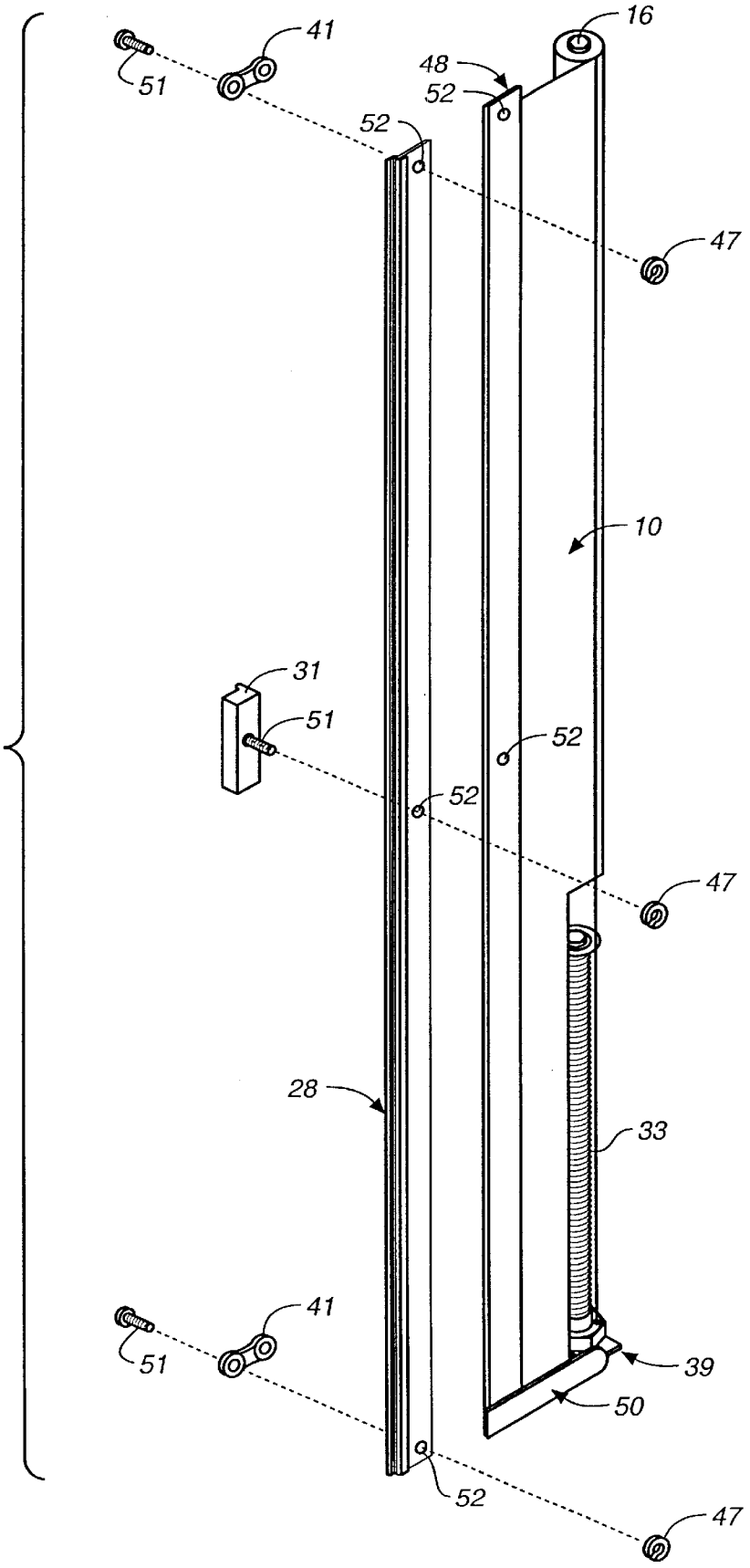
FIG. 23 is a rear perspective view of one embodiment of the replaceable shower screen assembly.

FIG. 23 depicts an alternative embodiment of the locking means for retaining the appropriate tension on the shower screen 10. In this embodiment, the locking means comprises a retaining member 50 which locks a component of the spring assembly, such as the spring shaft end plate 39 to the elongate rigid clip 48. Alternatively, the retaining member 50 may lock the spring shaft end plate 39 (or other component of the spring assembly) to the support member 28, where the support member 28 is directly attached to the leading edge of the screen 10, e.g. as shown in FIG. 12. The retaining member 50 is disengaged upon installation of the replaceable shower screen assembly in the housing 15. By connecting the spring shaft end plate 39 to the clip 48 or support member 28, the spring 33 will be kept in tension and the screen 10 can not unwind from around the roller 16 until the screen 10 has been fitted into the housing 15 and the retaining member 50 has been removed. This system can be used instead of the locking pin 36 shown in FIGS. 21 and 22, as the retaining member 50 prevents the screen 10 unwinding and has the added advantage that it holds the clip 48 or support member 28 close to the rolled screen 10. By preventing the screen 10 from unraveling from around the roller 16, the replaceable shower screen assembly is easier to install and is maintained in a neat rolled package until installation has been completed.

FIG. 23 further depicts one means for attaching support member 28 to elongate rigid clip 48. In particular, one or more pins 51 pass through corresponding apertures 52 in the support member 28 and elongate rigid clip 48 and are held in place by one or more clips 47 (erg. C clips). The pins 51 may further attach the top and bottom guide members 41 and 42, respectively, and handle 31 to the support member 28.

Thus it can be seen from the above that closure devices for shower enclosures are provided which increase the showering area within the enclosure and/or allow for a shower screen of the type disclosed herein to be replaced.

What is claimed is:

1. A closure device for a shower enclosure comprising a shower entrance surround and a replaceable shower screen assembly for use in combination, the shower entrance surround comprising a housing for containing the shower screen assembly, which housing is vertically mounted in the shower enclosure in use, the housing having a door for providing access to the interior thereof such that the shower screen assembly can be replaced and further providing mounting means for engaging the shower screen assembly; a top rail and a bottom rail; and engagement means mounted opposite the housing in use, wherein the engagement means is capable of retaining the shower screen in a closed position in use; and the shower screen assembly comprising a spring loaded roller with a polyester shower screen attached thereto and a rigid, elongate support member attached to the shower screen which provides a location means for co-operating with the engagement means of the shower entrance surround so as to retain the shower screen in a closed position in use, wherein the support member provides top and bottom guide members which are able to ride in grooves in the top and bottom rails, wherein the spring is pre-wound to an appropriate tension for the dimensions of the shower enclosure, and wherein the shower entrance surround and replaceable shower screen assembly are packaged together, with instructions for replacing the shower screen assembly as desired.

2. The closure device of claim 1 wherein the locking means comprises a locking pin which prevents rotation of the roller.

3. The closure device of claim 1 wherein the locking means comprises a retaining member which is attached to a spring shaft end plate and to a rigid elongate member attached to the screen.

* * * * *